US005628616A

United States Patent [19]

Lee

[11] Patent Number: 5,628,616

[45] Date of Patent: May 13, 1997

[54] DOWNHOLE PUMPING SYSTEM FOR RECOVERING LIQUIDS AND GAS

[75] Inventor: Woon Y. Lee, Bartlesville, Okla.

[73] Assignee: Camco International Inc., Houston, Tex.

[21] Appl. No.: 582,836

[22] Filed: Jan. 2, 1996

Related U.S. Application Data

[63] Continuation-in-part of Ser. No. 358,871, Dec. 19, 1994, abandoned.

[51] Int. Cl.[6] ..... F04D 29/22

[52] U.S. Cl. ..... 415/58.2; 415/58.3; 415/199.1; 415/901; 416/181; 416/186 R; 417/423.3; 417/424.2

[58] Field of Search ..... 415/56.2, 56.5, 415/57.1, 58.2, 58.3, 104, 106, 107, 198.1, 199.1, 199.2, 199.3, 901, 169.1, 169.2; 416/181, 186 R, 231 R; 417/423.3, 423.5, 424.1, 424.2; 96/196, 208; 166/105, 105.5; 210/416.1

[56] References Cited

U.S. PATENT DOCUMENTS

| | | | |
|---|---|---|---|
| 2,270,666 | 1/1942 | Arutunoff | 415/901 |
| 2,658,455 | 11/1953 | Seinfeld . | |
| 3,238,879 | 3/1966 | Shallenberg | 415/199.2 |
| 3,369,492 | 2/1968 | Berman | 415/901 |
| 4,778,341 | 10/1988 | Corradini et al. | 415/58.2 |
| 4,830,584 | 5/1989 | Mohn . | |
| 4,901,413 | 2/1990 | Cotherman et al. . | |
| 4,913,630 | 4/1990 | Cotherman et al. . | |

FOREIGN PATENT DOCUMENTS

| | | |
|---|---|---|
| 860898 | 12/1952 | Germany . |
| 2357305 | 5/1975 | Germany . |
| 2733631 | 2/1979 | Germany . |
| 221409 | 5/1942 | Switzerland . |
| 942648 | 11/1963 | United Kingdom . |

*Primary Examiner*—Edward K. Look
*Assistant Examiner*—Christopher Verdier

[57] ABSTRACT

A downhole pumping system for recovering liquids and gas, comprising a first centrifugal pump having internal features for mixing introduced gas into introduced liquids, and a second centrifugal pump having an intake in fluid communication with a discharge of the first centrifugal pump. In one prattled embodiment the internal features for mixing comprise improved impellers having a balance hole that extends through an upper surface of the impeller body into each of a plurality of internal flow chambers, and an additional passage in at least a plurality of the flow chambers. The additional passages cause some fluid to be recirculated in a manner that causes introduced gas to be mixed into the liquids, thereby increasing the pump's gas volume recovery ability.

4 Claims, 7 Drawing Sheets

DOWNHOLE PUMPING SYSTEM FOR RECOVERING LIQUIDS AND GAS

This application is a continuation-in-part application of application Ser. No. 08/358,871, filed Dec. 19, 1994 now abandoned.

BACKGROUND OF THE INVENTION

1. Field of the Invention.

The present invention relates to electric submergible pumping systems for recovering liquids and gas from a wellbore and, more particularly, to submergible pumping systems adapted to recover a higher volume percent of gas than previous pumping systems.

2. Description of Related Art.

Electric submergible pumping systems are commonly used to recover liquids from subterranean wellbores, and generally comprise an electric motor that operates a multi-stage centrifugal pump. Conventional centrifugal pumps tend to become gas locked and cease moving fluids when the gas content in the liquids exceeds a certain volume percent, which depends upon the gas pressure and the type and size of pump. In many oil and gas reservoirs the gas content of the fluids recovered to the surface can exceed the gas moving ability of centrifugal pumps. There is a need for an improved electric submergible pumping system to recover liquids and gas.

Those skilled in the art believe part of the problem of centrifugal pumps being able to recover liquids with relatively high gas content is caused by the configurations of the impellers. Centrifugal pumps are formed from a plurality of pump stages, with each stage including a stationary diffuser and a rotating impeller. A typical impeller is formed from an impeller body having an upper surface spaced from a lower surface with a plurality of angled vanes therebetween to define a plurality of flow chambers. A balance hole extends through the upper surface into each of a plurality of the flow chambers. In a typical centrifugal pump impeller, shown in FIG. 3, the fluid pressure in the area labeled "A" (Pa) is always less than the fluid pressure in the area labeled "B" (Pb) due to the centrifugal force generated by the impeller. If balance holes (numbered as "50" in FIG. 3) were not present, then the fluid pressure in area "C" (Pc) would be approximately equal to Pb. Additional downthrust would then be generated that directly leads to pump bearing failure. If Pc is decreased to be approximately equal to Pa, by the addition of the balance holes ("50"), the detrimental downthrust will be decreased. If Pa and Pc become approximately equal, then the pressure difference between Pb and Pc will be too great. In order to keep the fluid pressure in area "C" (Pc) at a desired level, fluid leakage between areas "B" and "C" should be minimized. Additionally, fluid leakage from area "D" to "A" and from area "B" to area "D" needs to be reduced to decrease the pressure drop across area "B".

In typical centrifugal pumps, as the volume percentage of gas in the fluid being moved increases a gas pocket or bubble will form in area "A". If the gas content becomes too great a relatively large gas bubble (shown in dotted lines) will form and effectively block all fluid flow therepast. In this case, the pump will cease to move fluid, and the pump will be referred to as being "gas locked". Additional equipment, such as rotary gas separators, are sometimes used on the inlet side of the centrifugal pump to remove as much gas as possible prior to the fluids being introduced thereinto. These gas separators have proven to be generally effective; however, the addition of a gas separator involves additional monies that must be spent on a well and adds additional components that can fail. In addition, in certain enhanced oil recovery projects, such as water, gas or polymer floods, the volume percentage of gas in the recovered fluids can vary greatly over the life of the project. Therefore, the well may not need a gas separator but for a relatively short period of time.

There is a need for an improved electric submergible pumping system that can move liquids with a relatively high gas content without experiencing gas locking, and which does not necessarily require the use of a gas separator.

SUMMARY OF THE INVENTION

The present invention has been contemplated to overcome the foregoing deficiencies and meet the above described needs. Specifically, the present invention is a downhole pumping system for recovering liquids and gas, comprising a first centrifugal pump having features for mixing introduced gas into introduced liquids, and a second centrifugal pump having an intake in fluid communication with a discharge of the first centrifugal pump. In one preferred embodiment of the present invention, the first centrifugal pump includes a plurality of impellers, each having an impeller body having an upper surface spaced from a lower surface with a plurality of angled vanes therebetween to define a plurality of flow chambers. A first passage extends through the upper surface into each of a plurality of the flow chambers, and recirculation features are included in at least a plurality of the flow chambers to aid in gas and liquid mixing that prevents gas locking.

In one preferred embodiment of the present invention the recirculation features comprise at least one second passage that extends through the upper surface into each of a plurality of the flow chambers. The second passages are spaced radially outwardly from the first passages. The spacing and configuration of the second passages permits additional fluid and gas mixing within each flow chamber to increase the quantity of gas that can be moved without experiencing gas locking.

DETAILED DESCRIPTION OF THE PREFERRED EMBODIMENTS

As briefly described above, the present invention is a downhole pumping system for recovering liquids and gas, comprising a first centrifugal pump having features for mixing introduced gas into introduced liquids, and a second centrifugal pump having an intake in fluid communication with a discharge of the first centrifugal pump. For the purposes of this discussion it will be assumed that the present invention is an electric submergible pumping system that has at least one multi-stage centrifugal pump to recover liquids and gas from a wellbore. However, it should be understood that the present invention can be used within other fluid moving devices, such as surface pumps and turbines. Further, the present discussion will assume that the pumping system, and therefore the pump's impeller and diffuser, is generally in a vertical position with respect to the earth so that certain items can be referred to herein as an "upper" or a "lower" member, yet there is no need that the present invention be used in any particular orientation, so that it can be used vertically, horizontally, or inclined, or even in an up-side down orientation with the motor above the pump. It also can be used in an industrial application on the earth's surface, as desired, in a horizontal, inclined or vertical orientation.

Figure 1:
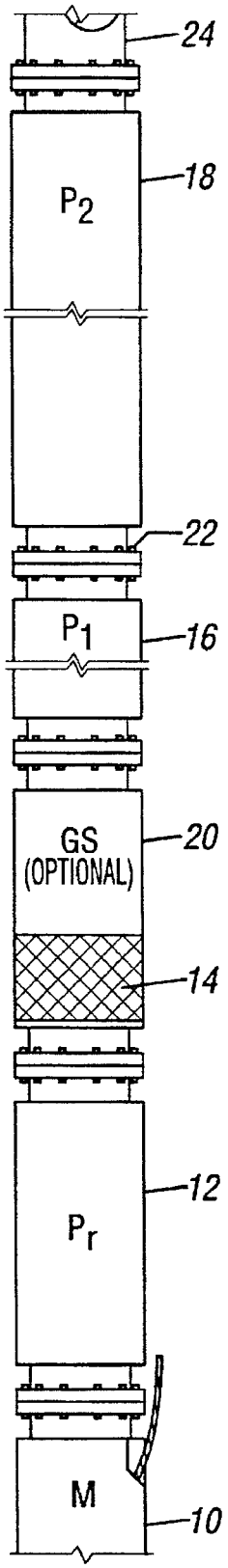
FIG. 1 is an elevational view of one preferred embodiment of an electric submergible pumping system of the present invention.

FIG. 1 shows one preferred embodiment of an electric submergible pumping system of the present invention comprising an electric motor 10, oil-filled motor protector 12, a screened intake unit 14, a first centrifugal pump 16, and a second centrifugal pump 18. An optional gas separator 20, as is well known to those skilled in the art, can be connected between the intake unit 14 and an intake of the first centrifugal pump 16. Further, more than one second centrifugal pump 18 can be used with the present invention, as is well known to those skilled in the art. Each of the above items are operatively connected together in any desired manner, such as by threaded tubular connections or preferably by bolts 22, as is well known to those skilled in the art. In this embodiment, wellbore fluids are introduced into the intake unit 14, and are passed into an intake (not shown) on the first centrifugal pump 16, to an intake (not shown) on the second centrifugal pump 18, and out to a tubing string 24 for discharge to the earth's surface for processing and transport.

To prevent gas lock and thereby increase the pumps's ability to recover wellbore fluids, the first centrifugal pump 16 includes features specifically designed for mixing introduced gas with introduced liquids. As used herein the term "introduced" gas or liquid means a fluid that enters the pump from the wellbore or from an auxiliary source, such as from another source within the same wellbore or from the earth's surface. As will described in more detail below, these features for mixing comprise special passages added to the pump's impellers. These passages cause the gas bubbles with the flow chambers of each impeller to be broken into smaller bubbles that are more easily mixed into and entrained with the oil and/or water being recovered. In one sense, the first centrifugal pump 16 acts as a supplementary pump to precondition the fluids prior to their introduction into the primary pump, ie. the second centrifugal pump 18.

The first centrifugal pump 16 can have fewer pump stages in comparison to the second centrifugal pump 18, the same number of stages, or more stages, as is desired. Typically, the first centrifugal pump 16 will have about 15 or more stages, with about 20–40 stages being preferable, depending upon the diameter of the pump, the gas content of the fluids and the desired flow rates. Also, the first centrifugal pump 16 is preferably the same diameter as the second centrifugal pump 18, but can be of a larger diameter for relatively low flow rates. For example, for flow rates of about 2,000 bbl/day or less, a 5 to 5½ inch diameter pump 16 can be used ahead of a 4 to 5 inch pump 18.

Figure 2:
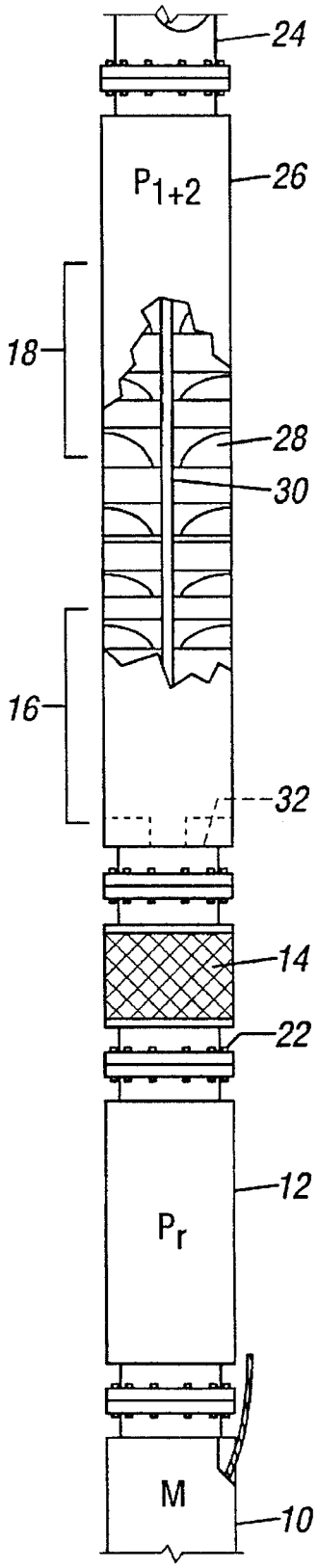
FIG. 2 is an elevational view of an alternate preferred embodiment of an electric submergible pumping system of the present invention.

An alternate preferred embodiment of the present invention is shown in FIG. 2 where the first centrifugal pump and the second centrifugal pump are combined as a single pump unit. Specifically, in FIG. 2 a combination pump unit is comprised of a pump housing 26 that is mechanically connected to the other components of the pumping system, as shown in FIG. 1, with a plurality of pump impellers 28 housed therein and rotated by a drive shaft 30. At least one of the impellers 28 and preferably a plurality of the impellers 28 adjacent an intake 32 of the combination pump unit include the above described passages for mixing gas and liquids, and thereby act as the first centrifugal pump, and the remaining impellers 28 do not have such passages, and thereby act as the second centrifugal pump.

Figure 3:
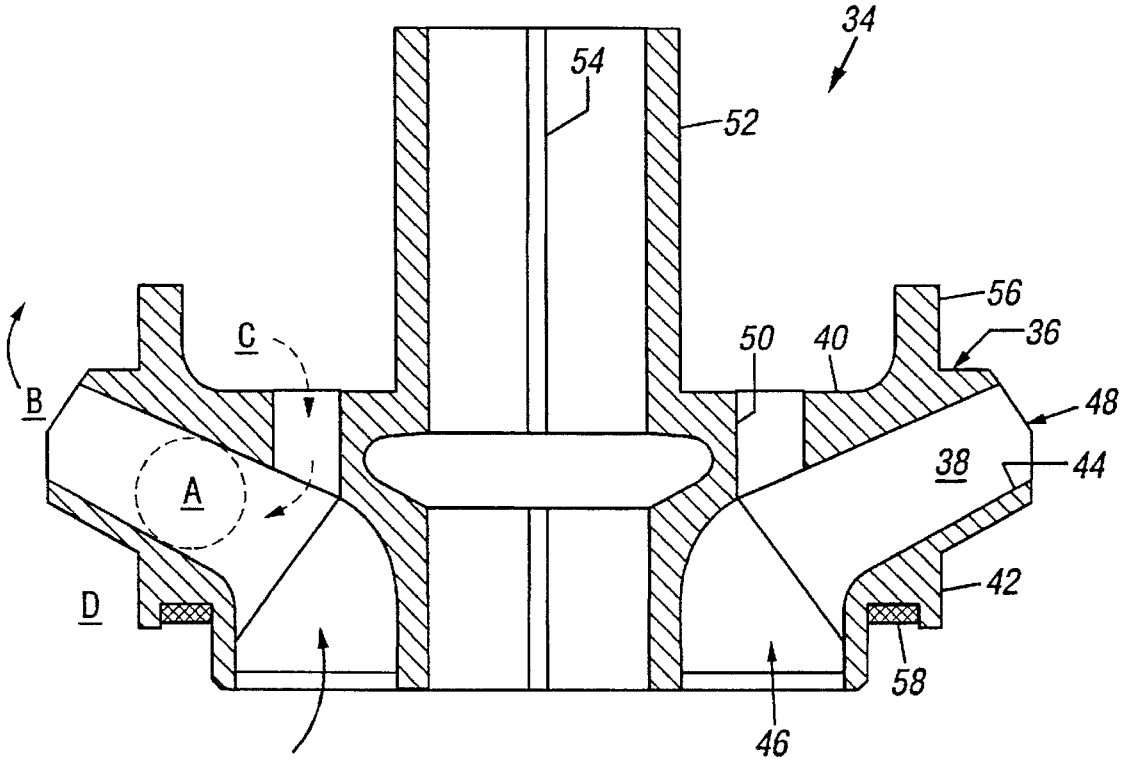
FIG. 3 (Prior Art)
FIG. 3 is a cross-sectional, elevational view of a centrifugal pump impeller of the Prior Art.

To aid in understanding the significance of the new features in the impellers used in the first centrifugal pump, a detailed discussion will be provided to describe the configuration and function of the prior pump stages and impellers. A typical pump stage is shown in FIG. 3 wherein an impeller 34 comprises a generally toroidal body 36 with a plurality of angled vanes 38 spaced between an upper surface 40 and a lower surface 42 to define a plurality of separate flow chambers 44. When the impeller 34 is rotated, the angle of the vanes 38 causes fluid to move from impeller inlets 46 through the flow chambers 44 to impeller outlets 48, and into an adjacent stationary diffuser (not shown), as is well known to those skilled in the art. A balance hole 50 is provided through the upper surface 40 of the impeller body 36 to allow fluid pressure equalization between areas "A" and "C". A cylindrical throat portion 52 extends from the impeller body 36 and includes a longitudinal slot 54 in the interior wall of the throat 52 for mechanical interconnection with a rotating drive shaft (not shown), which is operatively connected to a source of rotary motion, such as the electric motor 10. Further, the impeller body 36 includes an annular upper skirt 56, adjacent the impeller outlet 48, and a lower bearing surface 58 adjacent the impeller inlet 46.

As described briefly above, if the gas content of the fluid becomes too great, such as for example about 30 vol. % or greater, a gas pocket or bubble will form in area "A". As the gas content becomes too great one or more relatively large gas bubbles will form that effectively block all fluid flow therepast. In this case, the pump will cease to move fluid, and the pump will be referred to as being "gas locked".

Figure 4:
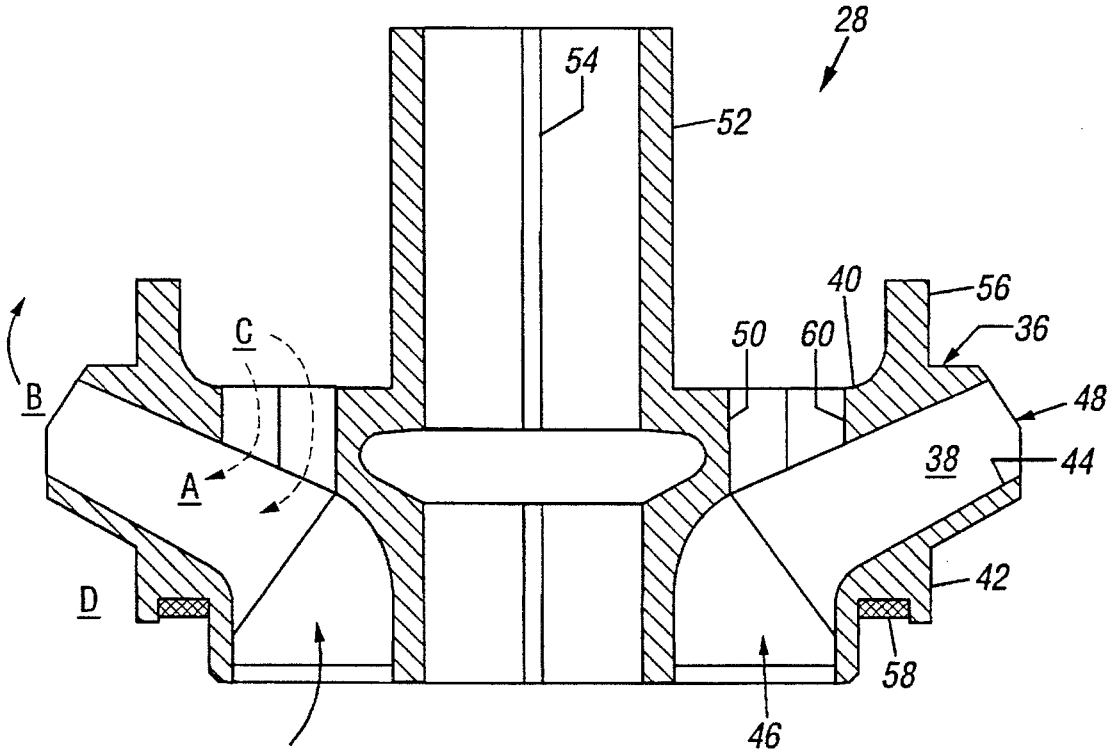
FIG. 4 is a cross-sectional, elevational view of one preferred embodiment of a centrifugal pump impeller for use in the present invention.
Figure 5:
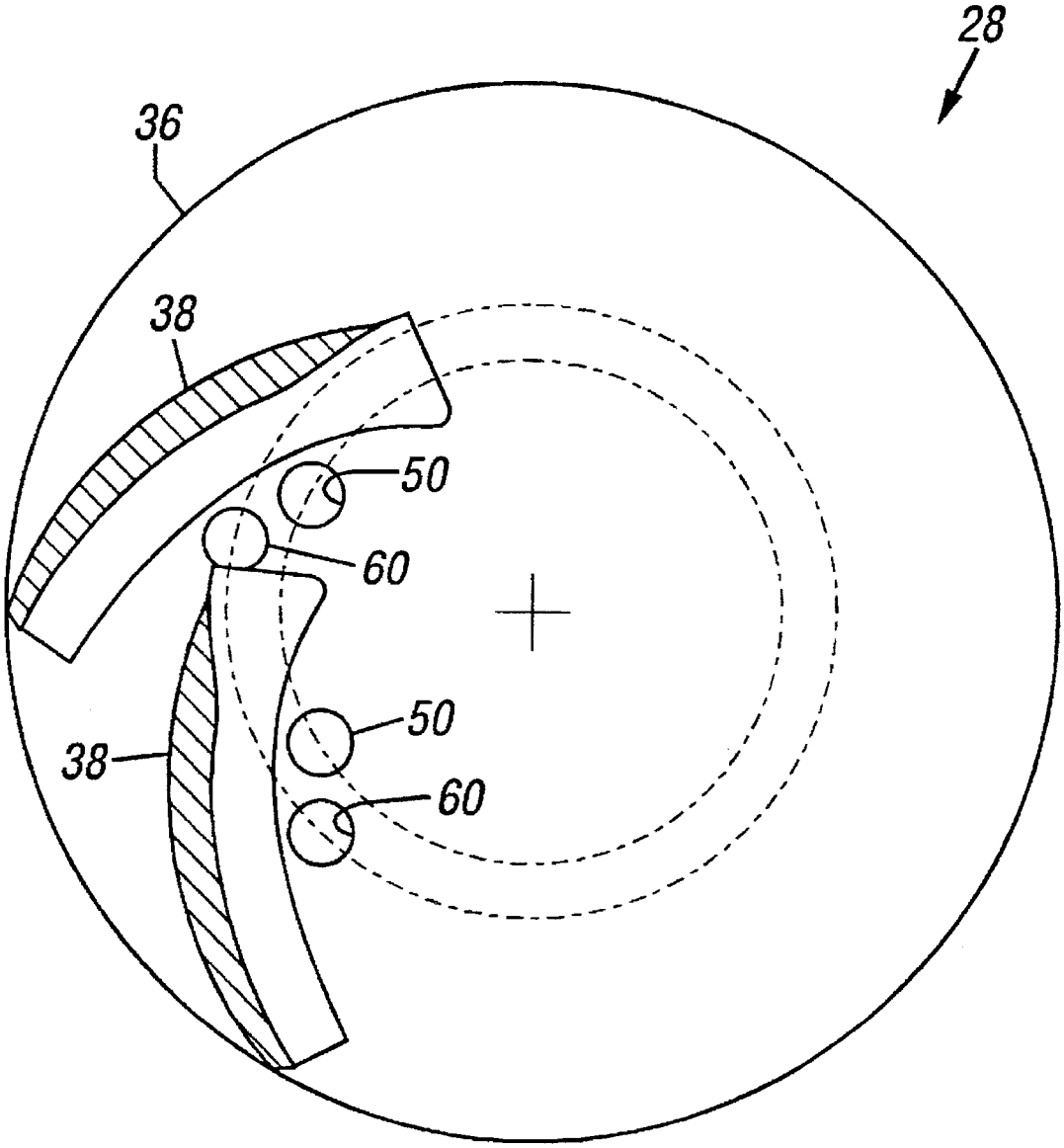
FIG. 5 is a cross-sectional view of the centrifugal pump impeller of FIG. 4.

To prevent gas lock, one preferred embodiment of the impeller 28 of the present invention has the same general configuration as the typical impeller 34 shown in FIG. 3, and for the purposes of this discussion will use the same reference numbers for common components for ease of understanding. As shown in FIGS. 4 and 5, the impeller 28 of the present invention has at least one additional balance or recirculation hole 60 that extends through the upper surface 40 into at least one of the flow chambers 44. Preferably, an additional recirculation hole 60 is included in each flow chamber 44. A longitudinal axis of each recirculation hole 60 is preferably parallel or approximately parallel to the longitudinal axis of the impeller body 36, but each such recirculation hole 60 need not be parallel and can be inclined outwardly or inwardly with respect to the impeller's longitudinal axis as may be desired. Additionally, the longitudinal axis of each recirculation hole 60 is generally parallel to the longitudinal axis of the adjacent balance hole 50. However, the longitudinal axis of the recirculation holes 60 can be inclined at any angle with respect to the adjacent balance hole 50. Further, one or more recirculation holes 60 can be angled differently from recirculation holes 60 in other groups of one or more flow chambers 44.

As shown in FIG. 5, the recirculation holes 60 are spaced radially outwardly from the balance holes 50, and in partial overlapping radial relationship. Additionally, each recirculation hole 60 is in trailing relationship with respect to the adjacent balance hole 50. This configuration is preferred, but is not mandatory, for ease of manufacturing and generally conforms to the curvature of the vanes 38. It has been found that the recirculation holes 60 preferably extend into the flow chambers 44 at or immediately ahead of the area within each flow chamber 44 where the gas bubble typically forms, such as in area "A". This location is important to ensure that turbulent flow occurs within the flow chambers 44.

In impellers 28 used in downhole pumping systems there is a need for the annular skirt 56 to limit fluid recirculation through the balance holes 50 and the recirculation holes 60. If the annular upper skirt 56 is not present, then the full discharge pressure is applied across the upper surface 40 resulting in greater downthrust, bearing wear and loss of pumping efficiency. The recirculation holes 60 are preferably located radially inwardly from the annular upper skirt 56 to limit fluid recirculation therethrough, and to be adjacent the area where the large gas bubbles would normally form (the area labeled as "A" in FIG. 3).

As described briefly above, the spacing, configuration and size of the recirculation holes 60 have been chosen to permit a limited amount of liquid to be internally recirculated to reduce the formation of gas bubbles in area "A" without materially reducing the pump's efficiency. As liquids are passed through the recirculation holes 60, the liquid will collide with and mix with the incoming fluids being passed through the flow chambers 44. This turbulent flow causes gas bubbles to be broken into smaller bubbles and to create a more homogeneous mixture than if no such turbulence was present, so a higher gas content fluid can be successfully moved without experiencing gas lock.

Figure 6:
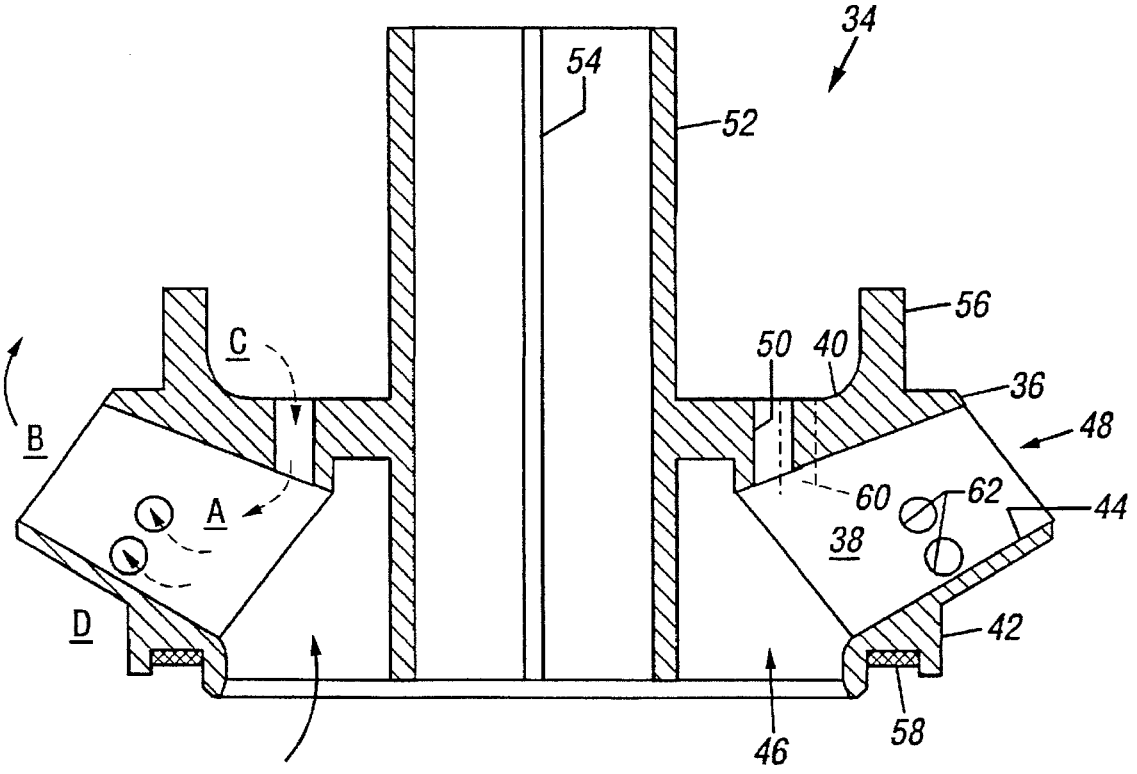
FIG. 6 is a cross-sectional, elevational view of an alternate preferred embodiment of a centrifugal pump impeller for use in the present invention.

The configuration of the recirculation holes 60 shown in FIGS. 4 and 5 are preferred for relatively low fluid flow rates, such as for example about 2,000 bbl/day or less depending upon the size and type of pump used. An alternate preferred embodiment of an impeller of the present invention is shown in FIG. 6 and is preferred for use at relatively high fluid flow rates. In this alterative preferred embodiment, an impeller 28 has single balance holes 50 in each flow chamber 44 and one or more recirculation holes 62 that extend through the vanes 38. The recirculation holes 62 permit some liquid to pass from one flow chamber 44 to an adjacent flow chamber 44 to cause turbulent flow, with the same benefits as the recirculation holes 60 described above in relation to FIGS. 4 and 5. The recirculation holes 62 are preferably spaced outwardly along the vane 38 to be radially outwardly spaced from the balance holes 50. The recirculation holes 62 can be spaced along the vane 38 in any desired pattern, but one effective pattern is for two or more recirculation holes 62 to be aligned along an imaginary axis that is tangential to the longitudinal axis of the vane 38. Further, the recirculation holes 62 are preferably offset adjacent a lower edge of the vanes 38 to provide greater liquid recirculation therethrough than if the recirculation holes 62 were offset adjacent an upper edge of the vanes 38 where a higher gas content would be recirculated therethrough.

In accordance with the preferred embodiments of the present invention, the first centrifugal pump 16 can contain only impellers 28 with the balance holes 60 through the upper surface 40, as shown in FIGS. 4 and 5; only impellers 28 with the balance holes 62 through the vanes 38, as shown in FIG. 6; only impellers 28 with balance holes 60 through the upper surface 40 and balance holes 62 through the vanes 38; or a combination of any of these three types of impellers.

Figure 7:
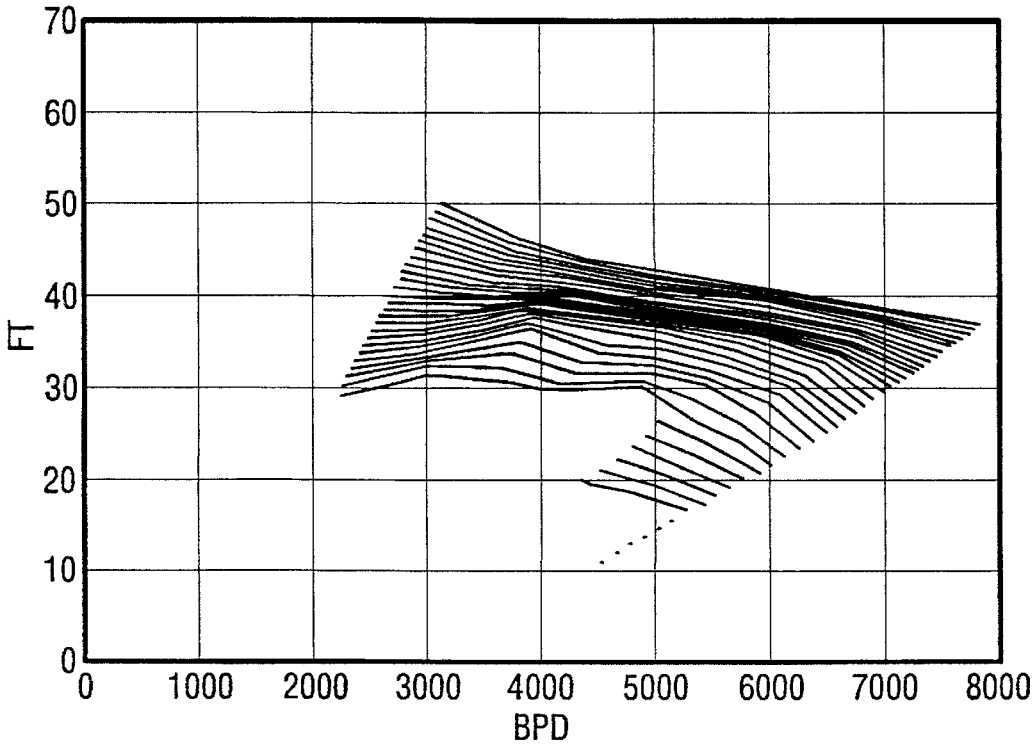
FIG. 7 is a graphical representation of the pumping efficiency of a Prior Art pump impeller with varying gas content in the liquid.
Figure 8:
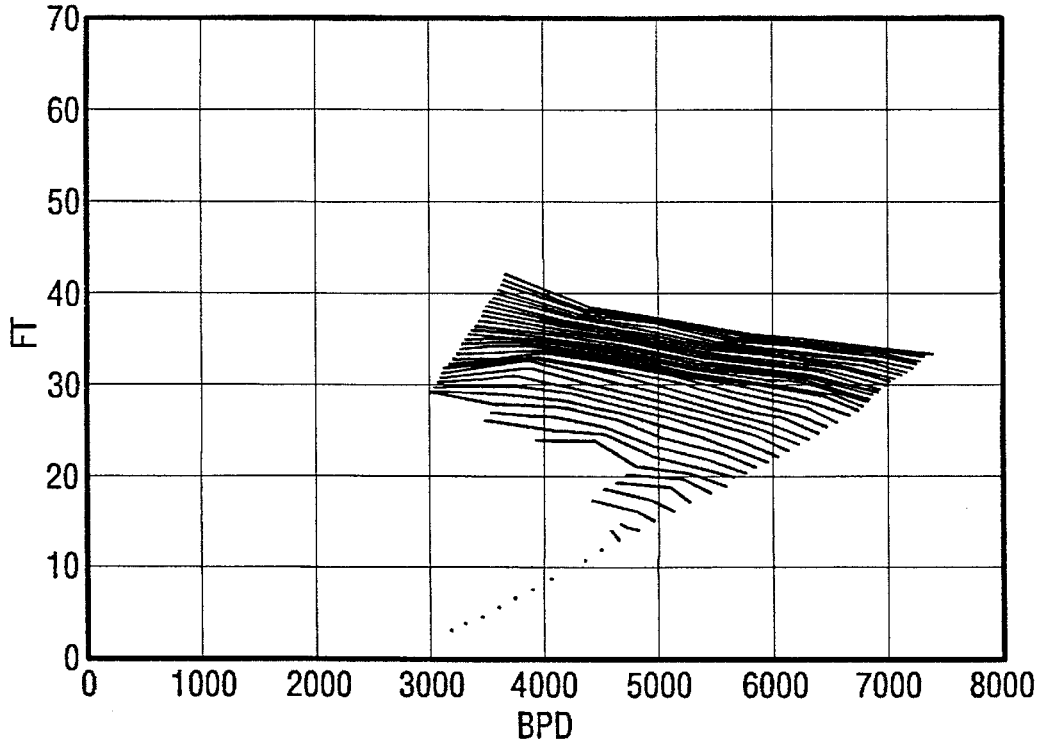
FIG. 8 is a graphical representation of the pumping efficiency of one preferred embodiment of a pump impeller of the present invention with varying gas content in the liquid.

To prove the effectiveness of the addition of the recirculation holes 60 in an impeller, a test was conducted wherein a standard 5.4" O.D. Reda 540 Series SN8500 pump was tested at various flow rates, measured in barrels per day ("bpd"). The standard pump's performance was measured for the pressure generated, measured in feet of fluid head, with varying amounts of introduced gas. FIG. 7 shows a plot of flow rate vs fluid head for one volume percent (1 vol. %) increments of gas, ie. air for these tests, in the fluid stream of oil, having a viscosity of water. At about 31 vol. % gas content the flow curves cease, which indicates that the pump became gas locked and no fluid could be pumped. The same pump was disassembled and the standard impellers were replaced by new impellers having the configuration shown in FIGS. 4 and 5, with the recirculation holes 60 being about 7 mm in diameter and with a centerline spaced about 33 mm from the longitudinal centerline of the impeller. The same test was conducted, and the test results are shown in FIG. 8, wherein it can be seen that the flow curves continue past the previous gas lock level of 31 vol. % gas and extend to 35 vol. % gas content. This shows a 4 vol. % to 5 vol. % increase in the gas content that can be successfully pumped without the need for additional gas separation equipment.

Figure 9:
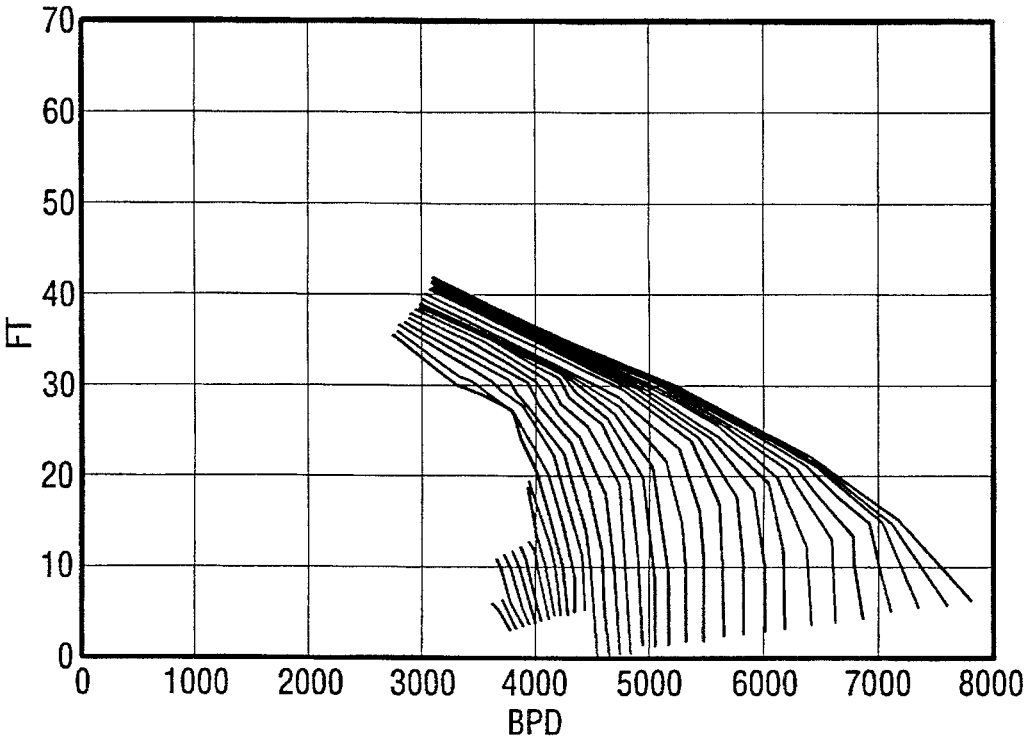
FIG. 9 is a graphical representation of the pumping efficiency of a Prior Art pumping system with varying gas content in the liquid.
Figure 10:
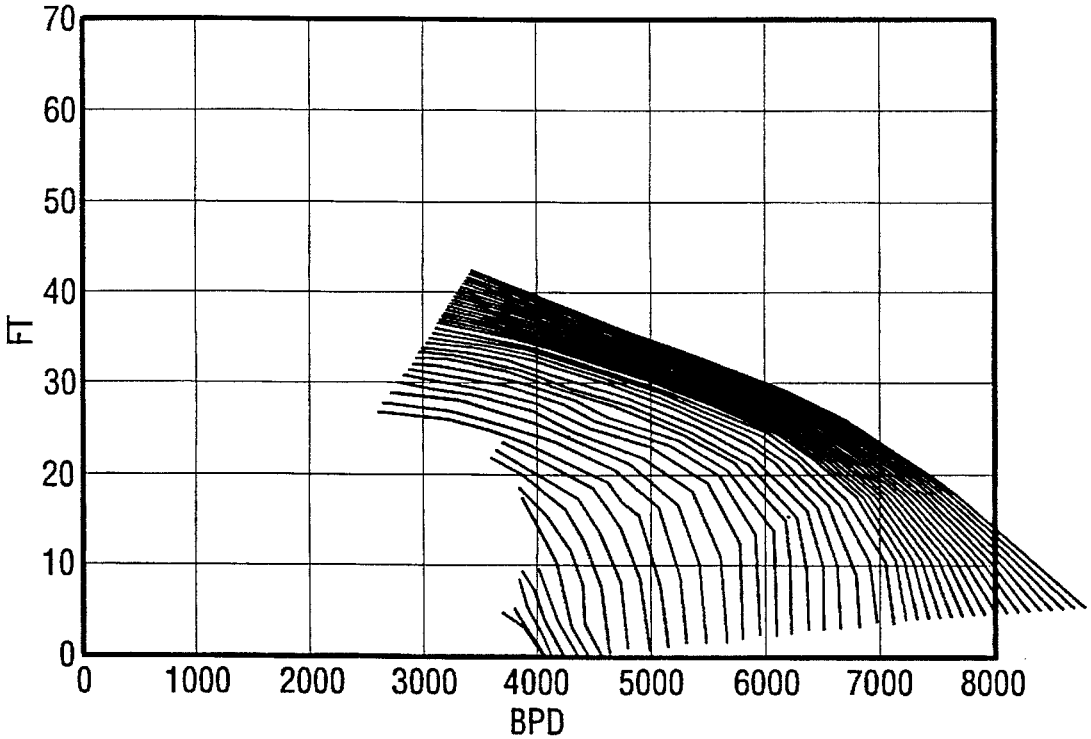
FIG. 10 is a graphical representation of the pumping efficiency of one preferred embodiment of an electric submergible pumping system of the present invention with varying gas content in the liquid.

To prove the effectiveness of the downhole pumping system of the present invention as compared to a conventional pumping system, additional tests were conducted wherein a standard 5.12" O.D. Reda G Series GN5200 pump was tested at various flow rates, measured in barrels per day ("bpd"). The standard pump's performance was measured for the pressure generated, measured in feet of fluid head, with varying amounts of introduced gas. FIG. 9 shows a plot of flow rate vs. fluid head for one volume percent (1 vol. %) increments of gas, ie. air for these tests, in the fluid stream of oil, having a viscosity of water. At about 25 vol. % gas content the flow curves cease, which indicates that the pump became gas locked and no fluid could be pumped. The GN5200 pump was disconnected from its intake and the electric motor, and a 5.12" O.D. modified pump was connected between the intake and the GN5200 pump. This modified pump had 13 stages formed from impellers having the configuration shown in FIGS. 4 and 5, with the recirculation holes 60 being about 7 mm in diameter and with a centerline spaced about 33 mm from the longitudinal centerline of the impeller. The same test were conducted, and the test results are shown in FIG. 10, wherein it can be seen that the flow curves continue past the previous gas lock level of 25 vol. % gas and extend to 35 vol. % gas content. This shows a 10 vol. % increase in the gas content that can be successfully pumped without the need for additional gas separation equipment.

Whereas the present invention has been described in relation to the drawings attached hereto, it should be understood that other and further modifications, apart from those shown or suggested herein, may be made within the scope and spirit of the present invention.

What is claimed is:

1. A downhole dual pumping system for recovering a mixture of liquids and gas from a wellbore, comprising:

a first centrifugal pump, comprising a plurality of impellers having an impeller body with an upper surface spaced from a lower surface with a plurality of angled vanes therebetween to define a plurality of flow chambers, a first passage extending through the upper surface into each of a pluralitiy of the flow chambers, and recirculation openings within a plurality of the flow chambers, separate from the first passages, the upper surface of each impeller body includes an annular skirt, with the recirculation openings located radially inwardly from and adjacent the annular skirt;

a second centrifugal pump connected to the first centrifugal pump, and having an intake in fluid communication with a discharge of the first centrifugal pump and a discharge in fluid communication with means to convey the mixture to the earth's surface; and a motor connected to the first centrifugal pump for powering the first centrifugal pump and the second centrifugal pump;

whereby the recirculation openings in the first centrifugal pump cause the liquids and gas to become sufficiently blended to prevent gas lock in the second centrifugal pump.

2. A downhole dual pumping system of claim 1 wherein the recirculation openings comprise a second passage extending through the upper surface into each of a plurality of the flow chambers; and the second passages are spaced radially outwardly from the first passages.

3. A downhole dual pumping system of claim 1 wherein the recirculation openings comprise a second passage extending through each of a plurality of the vanes from one of the flow chambers into an adjacent one of the flow chambers; and the second passages are spaced radially outwardly from the first passages.

4. A method of recovering a mixture of liquids and gas from a wellbore, comprising:

(a) introducing said mixture of liquids and gas from a wellbore into said first centrifugal pump located within the wellbore, the first centrifugal pump having a plurality of impellers each with an impeller body having an upper surface spaced from a lower surface with a plurality of angled vanes therebetween to define a plurality of flow chambers, a first passage extending through the upper surface into each of a plurality of the flow chambers, and recirculation openings within a plurality of the flow chambers, separate from the first passages; the upper surface of each impeller body includes an annular skirt with the recirculation openings located radially inwardly from and adjacent the annular skirt;

(b) introducing the mixture exiting the first centrifugal pump into a second centrifugal pump, the second centrifugal pump being connected to the first centrifugal pump and driven by a common drive source; and (c) introducing the mixture exiting the second centrifugal pump into means for conveying the mixture to the earth's surface;

whereby the gas is sufficiently blended into the liquids by the recirculation openings in the first centrifugal pump to prevent gas lock when the mixture passes through the second centrifugal pump.

* * * * *